US007250579B2

(12) United States Patent
Ahlers et al.

(10) Patent No.: US 7,250,579 B2
(45) Date of Patent: Jul. 31, 2007

(54) LARGE ACTUATION AREA SWITCHING DEVICE

(75) Inventors: Shawn Ahlers, Sunrise, FL (US); Steve Severson, Pompano Beach, FL (US)

(73) Assignee: Micro Pneumatic Logic, Inc., Pompano Beach, FL (US)

( * ) Notice: Subject to any disclaimer, the term of this patent is extended or adjusted under 35 U.S.C. 154(b) by 0 days.

(21) Appl. No.: 11/231,505

(22) Filed: Sep. 21, 2005

(65) Prior Publication Data

US 2007/0062795 A1 Mar. 22, 2007

(51) Int. Cl.
*H01H 3/00* (2006.01)

(52) U.S. Cl. ..... 200/329; 200/293

(58) Field of Classification Search ..... 200/293, 200/329

See application file for complete search history.

(56) References Cited

U.S. PATENT DOCUMENTS 4,588,877 A * 5/1986 Mizuta et al. ..... 200/406
5,059,754 A * 10/1991 Kaichi et al. ..... 200/332.1
5,510,587 A * 4/1996 Reiter ..... 200/341
5,823,325 A * 10/1998 Lin ..... 200/344
6,906,269 B2 * 6/2005 Nishimura et al. ..... 200/4
6,995,325 B2 * 2/2006 Sakou ..... 200/5 R
2001/0032779 A1 * 10/2001 Davidson et al. ..... 200/341
2001/0054547 A1 * 12/2001 Hattori ..... 200/302.1
2005/0092590 A1 * 5/2005 Sakou ..... 200/329
2005/0224329 A1 * 10/2005 Milo ..... 200/341
2006/0131153 A1 * 6/2006 Asada ..... 200/341

FOREIGN PATENT DOCUMENTS

DK 3405654 A1 8/1985
EP 0267541 A2 5/1988

OTHER PUBLICATIONS

Jan. 16, 2007 European Search Report.

* cited by examiner

*Primary Examiner*—Michael A. Friedhofer
*Assistant Examiner*—Lisa Klaus
(74) *Attorney, Agent, or Firm*—Cooper & Dunham LLP

(57) ABSTRACT

A large actuation area switching device includes a housing for holding a switch, means for compression and at least three slotted hinges. The slotted hinges create axes of operation such that a force applied to any point on the surface of the housing actuates the switch.

10 Claims, 3 Drawing Sheets

LARGE ACTUATION AREA SWITCHING DEVICE

TECHNICAL FIELD

This application relates to actuation switching devices, and more specifically to a large actuation area switching device that can be activated upon applying a force anywhere on its face.

BACKGROUND

It is well known in the art to cover or enclose switches with a protective housing that in addition acts as an actuation mechanism. In a relaxed state, a top member of the housing sits directly over the switch but does not actuate the underlying switch. By applying an external force on the surface of the top member of the housing directly over the switch, the top member of the housing (or actuation mechanism attached thereto) is depressed to actuate the underlying switch. When the external force is removed from the surface of the top member of the housing, the flexible top member returns to a relaxed state.

A disadvantage of known actuation switching devices is that an external force must be applied at a specific point, and in a substantially perpendicular direction to the surface of the top member of the housing, in order to ensure that the top member of the housing (or actuation mechanism attached thereto) makes physical contact with the switch, thereby activating the switch. Accordingly, prior art actuation switching devices have numerous "dead" spots along the surface of the top member of the housing that would not activate the switch no matter how much external force is applied at those "dead" spots. Other prior art actuation switching devices attempt to eliminate the numerous "dead" spots by utilizing multiple switches. Utilizing multiple switches, however, increases manufacturing time and costs.

Another disadvantage of known actuation switching devices is the small size of such actuation switching devices. Known actuation switching devices tend to be not much bigger than the switches they cover. These known devices may be difficult to utilize if a user must activate a switch quickly, has both hands preoccupied, or has poor eyesight.

Accordingly, there is a need for a large actuation area switching device that can be activated upon applying a force anywhere on its surface.

SUMMARY OF THE INVENTION

It is therefore an object of the present invention to provide a device that serves to activate a switch upon applying a force anywhere on its surface, thus eliminating any "dead" spots that were once prevalent with prior art actuation switching devices.

It is another object of the present invention to provide a device that serves to activate a single switch upon applying a force anywhere on its surface, eliminating the manufacturing time and costs associated with using multiple switches of known prior art actuation switching devices.

It is another object of the present invention to provide a device that has a large actuation surface such that a switch may be activated by a user if the user must act quickly, has both hands preoccupied, or has poor eyesight. Examples of useful applications include, but are not limited to, emergency switches, ice/water dispensers, door openers, car horns and any other applications that have switching devices.

Accordingly, the present invention is directed to a large actuation area switching device comprising a housing holding a switch, an element for compression, and at least three slotted hinges. The slotted hinges create axes of operation such that force applied to any point on the surface of the housing actuates the switch.

BRIEF DESCRIPTION OF DRAWINGS

The features of the present application can be more readily understood from the detailed description below with reference to the accompanying drawings herein.

DETAILED DESCRIPTION

Figure 1:
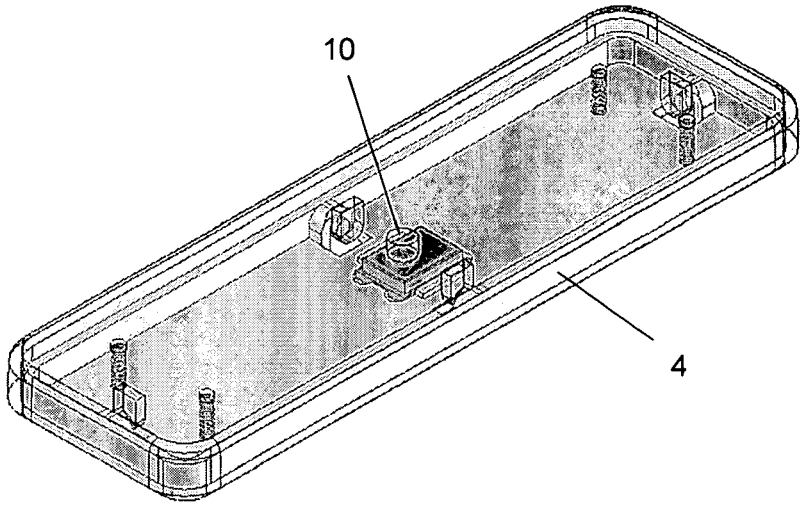
FIG. 1 is an assembled view of a large actuation area switching device in accordance with an embodiment of the present invention.
Figure 2:
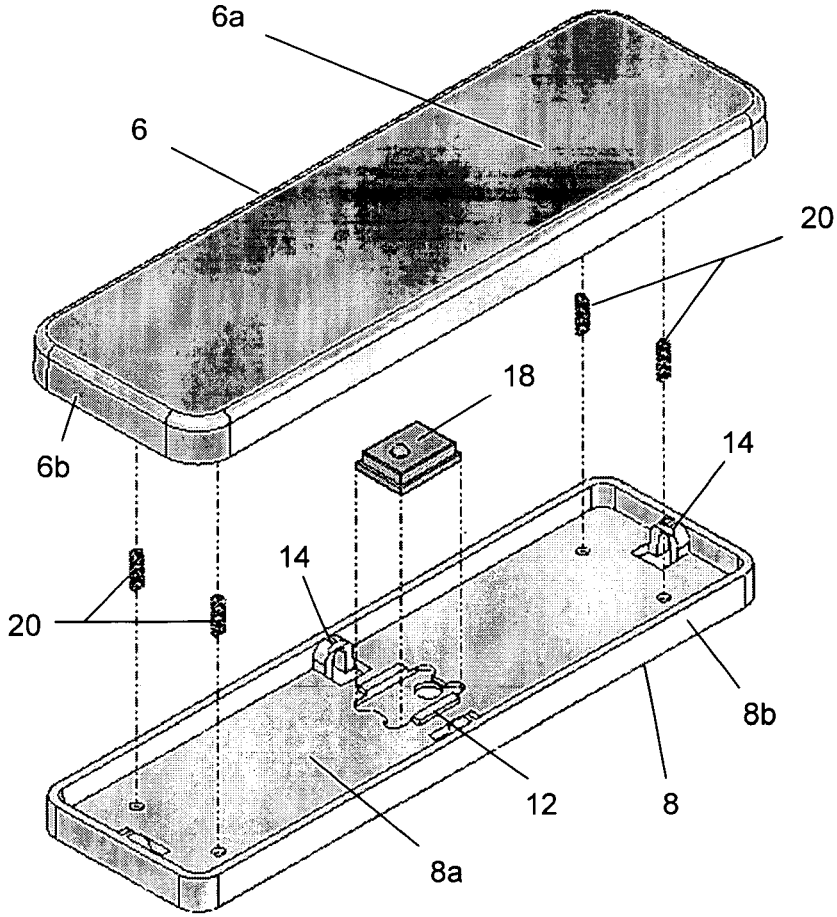
FIG. 2 is an exploded view of a large actuation area switching device in accordance with an embodiment of the present invention.
Figure 3:
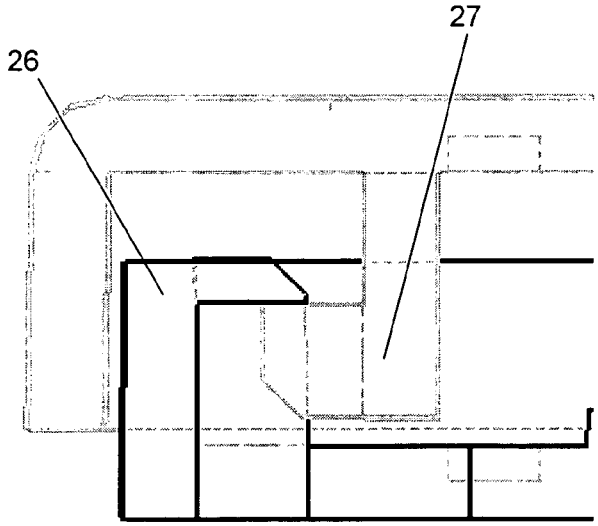
FIG. 3 is cross-sectional view of a slotted hinge of a large actuation area switching device in accordance with an embodiment of the present invention.
Figure 4:
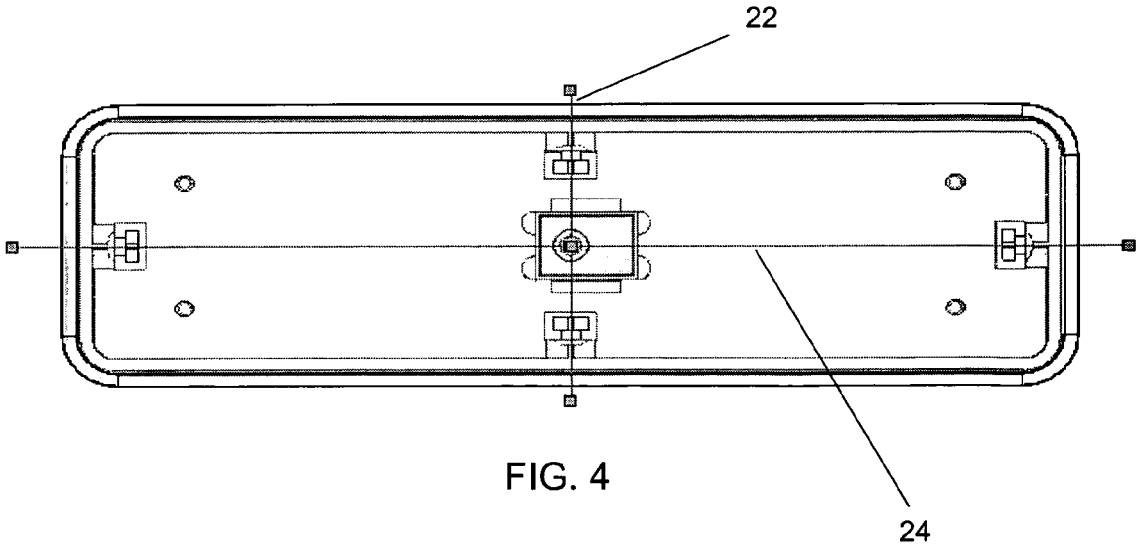
FIG. 4 is a top plan view of a large actuation area switching device in accordance with an embodiment of the present invention.

As shown in FIGS. 1 and 2, a large actuation area switching device, generally designated 2, comprises a housing 4, a switch 18, at least three slotted hinges 14 and compression elements 20.

While housing 4 is shown as a rectangular configuration, other shapes may be employed. Housing 4 includes an upper housing section 6 and a lower housing section 8. Upper housing section 6 includes a top wall 6*a* and side walls 6*b*. Lower housing section 8 includes a bottom wall 8*a* and side walls 8*b*. The inner perimeter of side walls 6*b* is approximately the same size as the outer perimeter of side walls 8*b*, allowing the upper housing section 6 to fit over lower housing section 8, as shown in FIG. 1. Upper and lower housing sections 6 and 8, respectively, are made of suitable materials, such as plastic, and made by known methods, such as molding.

A recess 12 is formed on the interior face of lower housing section 8 for holding switch 18 therein. A variety of switches known in the art, including, but not limited to, miniature sealed switches, reed switches, and opto-electrical switches, may be used for switch 18 in the present invention. Upper housing section 6 further comprises a plunger 10 on its interior surface. Plunger 10 is positioned directly on top of switch 18 and will actuate switch 18 when upper housing section 6 is sufficiently depressed regardless of where on upper housing section 6 a force is applied.

Upper and lower housing sections 6 and 8, respectively, are secured to one another by at least three slotted hinges 14.

The slotted hinges 14 create axes of operation 22 and 24. So long as axes of operation 22 and 24 are not parallel to one another, switch 18 can be actuated by applying a force anywhere on the face of upper housing section 6.

If n slotted hinges are used (where n≧3), then n axes of operation are created. So long as at least one axis of operation is not parallel to the remaining axes of operation, large actuation area switching device 2 can be actuated by applying a force anywhere on its face. That is, large actuation area switching device 2 will still function properly when n−1 axes of operation are parallel to one another, so long as at least one axis of operation is not parallel to the n−1 axes of operation.

Each slotted hinge 14 is comprised of a slot element 26 and a pin 27. Slot element 26 is attached to lower housing section 8 while pin 27 is attached to upper housing section 6. There must be sufficient clearance between slot element 26 and pin 27 to permit uninhibited movement and prevent binding during off-axis actuation. During assembly, chamfers on slot element 26 and pin 27 enables slot element 26 and pin 27 to deflect and snap into position after pin 27 clears the top of slot element 26.

Compression elements 20 keep switch 18 from being actuated when large actuation area switching device 2 is at a relaxed state. Although compression springs are shown in the figures to be the preferred elements for compression, any element that can provide a resistive spring force, for example, a cantilever member, may be used instead.

Figure 5:
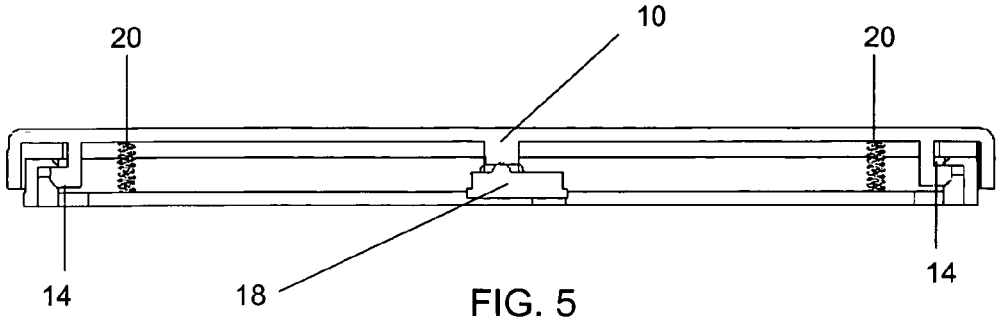
FIG. 5 is a cross-sectional view of a large actuation area switching device in a relaxed state in accordance with an embodiment of the present invention.

As shown in FIG. 5, compression elements 20 generate a spring force to drive pins 27 of upper housing section 6 to the end of slot elements 26 of the lower housing section 8 when no force is applied to the top surface of upper housing section 6.

Figure 6:
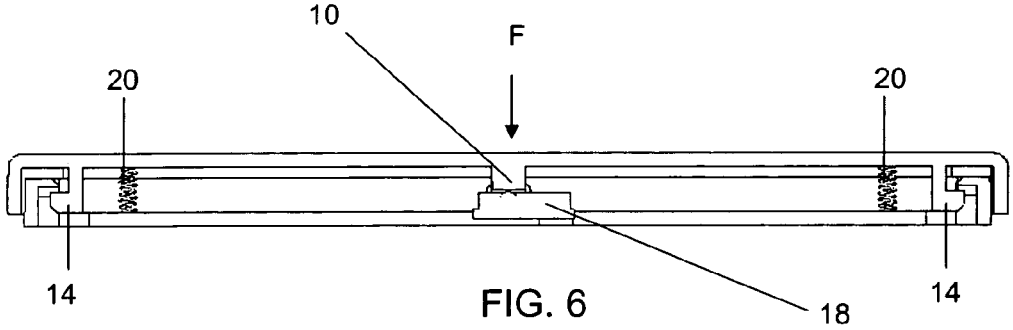
FIG. 6 is a cross-sectional view of a large actuation area switching device in an activated state in accordance with an embodiment of the present invention.

As shown in FIG. 6, when a force F that is greater than the opposing generated spring force is applied directly over switch 18, upper housing section 6 moves toward lower housing section 8. As a result, plunger 10 actuates switch 18. When the force is removed, large actuation area switching device 2 returns to a relaxed state.

Figure 7:
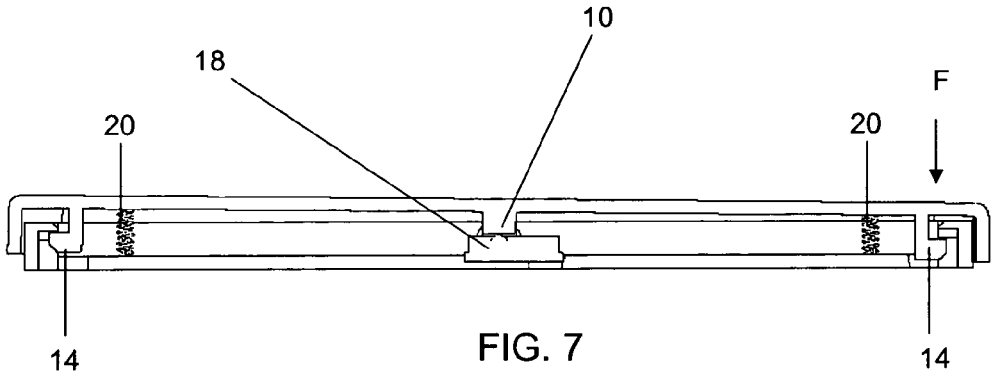
FIG. 7 is a cross-sectional view of a large actuation area switching device in an activated state in accordance with an embodiment of the present invention.
Figure 8:
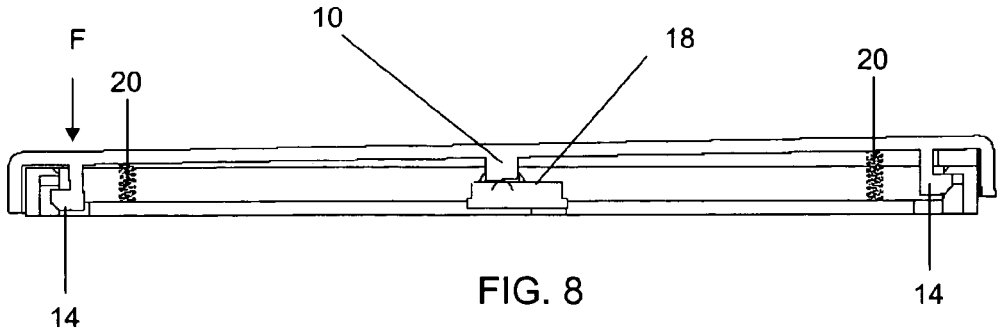
FIG. 8 is a cross-sectional view of a large actuation area switching device in an activated state in accordance with an embodiment of the present invention.

As shown in FIGS. 7 and 8, when a force F that is greater than the opposing generated spring force is applied at any point except directly over switch 18, the slotted hinge 14 closest to the applied force moves upper housing section 6 toward lower housing section 8 while the opposing slotted hinges 14 act as pivots along the axis of operation in use. Lateral movement of upper housing section 6 is constrained by the clearance between slot element 26 and pin 27 along the axis of operation not in use. As a result, plunger 10 actuates switch 18. When the force is removed large actuation area switching device 2 returns to a relaxed state.

In describing exemplary embodiments, specific terminology is employed for the sake of clarity in this disclosure. The disclosure of this patent specification, however, is not intended to be limited to the specific terminology so selected, and it is to be understood that each specific element includes all technical equivalents that operate in a similar manner.

In addition, the above specific embodiments are illustrative, and many variations can be introduced on these embodiments without departing from the spirit of the disclosure or from the scope of the appended claims. For example, elements and/or features of different illustrative embodiments may be combined with each other and/or substituted for each other within the scope of this disclosure and appended claims.

What is claimed is:

1. A large actuation area switching device, comprising:

a housing including an upper housing surface;

a movable top member, said top member further comprising a plunger and at least three pins;

a bottom member, said bottom member further comprising at least three slots, wherein said slots and pins connect to form at least three slotted hinges;

a switch mechanism including one switch housed on said bottom member; and one or more compression elements between said top and bottom members, to apply a resistive force to separate said top and bottom members, wherein when an actuation force is applied to any point on said upper housing surface, said top member moves towards said bottom member and thereby drives said plunger towards said one switch to mechanically actuate said switch mechanism.

2. The large actuation area switching device of claim 1, wherein said switch mechanism is configured for activation by applying force to any point on a top surface of said top member.

3. The large actuation area switching device of claim 1, wherein said plunger is positioned on top of said one switch.

4. The large actuation area switching device of claim 1, wherein when said actuation force applied to said upper housing surface exceeds said resistive force of said compression element, said top member is moved toward said bottom member to cause said plunger to actuate said switch.

5. The large actuation area switching device of claim 1, wherein when said actuation force applied to said any point on said upper housing surface is less than said resistive force of said compression element, said switch mechanism is not actuated.

6. The large actuation area switching device of claim 1, wherein said at least three slotted hinges cause two or more axes of operation to be formed in said large actuation area switching device, and at least one of the axes of operation is not parallel to any of the remaining axes of operation.

7. A large actuation area switching device comprising;

a housing including an upper housing surface and an inner surface;

a switch mechanism including one switch; and an actuation mechanism configured to actuate the switch mechanism, and including a plunger positioned on said inner surface of said housing and above said one switch; and at least one compression element, wherein said switch includes top and bottom members, the one switch is positioned between said top and bottom members, and the compression element is positioned between said top and bottom members, to apply a resistive force to keep said top and bottom members from actuating said switch mechanism, and wherein when an actuation force is applied to any point on said upper housing surface, said plunger is driven towards said one switch to mechanically actuate said switch mechanism.

8. The large actuation area switching device of claim 7, wherein said plunger is positioned on top of said one switch.

9. The large actuation area switching device of claim 7, wherein when said actuation force applied to said any point on said upper housing surface exceeds said resistive force of said compression element, said top member is moved toward said bottom member to cause said actuation mechanism to actuate said switch mechanism.

10. The large actuation area switching device of claim 7, wherein when said actuation force applied to said any point on said upper housing surface is less than said resistive force of said compression element, said switch mechanism is not actuated.

* * * * *